United States Patent [19]

Hanyu et al.

[11] Patent Number: 5,020,461

[45] Date of Patent: Jun. 4, 1991

[54] LOWER THREAD AMOUNT DISPLAY DEVICE OF SEWING MACHINE

[75] Inventors: Susumu Hanyu; Kenji Kato, both of Tokyo, Japan

[73] Assignee: Janome Sewing Machine Company Limited, Tokyo, Japan

[21] Appl. No.: 553,446

[22] Filed: Jul. 13, 1990

[30] Foreign Application Priority Data

Jul. 14, 1989 [JP] Japan ..... 1-180160

[51] Int. Cl.[5] ..... D05B 59/02

[52] U.S. Cl. ..... 112/278; 250/571

[58] Field of Search ..... 112/278, 273, 121.11, 112/275, 277; 250/561, 571

[56] References Cited

U.S. PATENT DOCUMENTS

| | | | |
|---|---|---|---|
| 3,738,296 | 6/1973 | MacKenzie et al. | 112/273 |
| 3,991,692 | 11/1976 | Papajewski et al. | 112/278 |
| 4,237,807 | 12/1980 | Meier et al. | 112/278 |
| 4,333,411 | 6/1982 | Lerner | 112/278 |
| 4,693,196 | 9/1987 | Hager | 112/273 |

FOREIGN PATENT DOCUMENTS

| | | | |
|---|---|---|---|
| 0009570 | 4/1980 | European Pat. Off. . | |
| 55-43897 | 9/1978 | Japan . | |
| 55-73287 | 6/1980 | Japan . | |
| 58-12684 | 1/1983 | Japan . | |
| 0259293 | 12/1985 | Japan | 112/273 |
| 0185293 | 8/1986 | Japan | 112/278 |

*Primary Examiner*—Peter Nerbun

*Attorney, Agent, or Firm*—Frishauf, Holtz, Goodman & Woodward

[57] ABSTRACT

In an apparatus for detecting and displaying a residual quantity of lower or under thread (12) of a sewing machine, an under-thread bobbin (10) is provided with transparent flange portions (10*a*) permitting the light rays emitted from a light emitting device of a photosensor (19) to pass through the flange portions (10*a* ) of the bobbin (10). The light rays having passed through the bobbin (10) are then reflected by a reflecting means or mirror (21) affixed to a back surface of a bed of the sewing machine to impinge on a light receiving device of the photosensor (19) so that the photosensor (19) detects the residual quantity of the lower thread (12) of the sewing machine. In the photosensor (19), the light emitting device is integrally formed with the light receiving device to save space.

3 Claims, 6 Drawing Sheets

LOWER THREAD AMOUNT DISPLAY DEVICE OF SEWING MACHINE

BACKGROUND OF THE INVENTION

5. Field of the Invention

The present invention relates to a sewing machine and more particularly relates to an apparatus for detecting/displaying a residual quantity of lower or under thread of a sewing machine.

2. Description of the Prior Art

In a sewing machine, in general, an under-thread bobbin on which an under or lower thread is wound is contained inside a bobbin carrier. The bobbin carrier is mounted inside a rotating hook in an inserted manner, while being prevented from rotating by a detaining member during sewing operation. On the other hand, the hook is rotated in synchronism with rotation of an upper driver shaft which vertically reciprocates a machine needle carrying an upper thread, and catches the upper thread to take around the bobbin carrier so that the upper-thread is interlocked with the lower thread as the needle goes up, and thus lock stitches are formed.

In a conventional sewing machines, for example, as shwon in FIG. 10 and as disclosed in JP-A No. 58-12684 (cores. to U.S. Pat. No. 4,333,411), a detecting means for detecting a residual quantity of the under thread wound on the bobbin is constructed of a light emitting device and light receiving device both of which are disposed outside the rotating hook so that light rays emitted from the light emitting device are oriented to the light receiving device is a direction perpendicular to an axis of the under-thread bobbin to impinge on the light receiving device, whereby an amount of light passed through the bobbin is detected by the light receiving device to determine a residual quantity of the under thread still wound on the bobbin.

However, the conventional detecting means of the above construction has a problem of a poor detection reliability in case that if the light range is shorter than the axis of the bobbin, only a part of the residual quantity of the under thread wound on the bobbin is detected.

If the light range is made equal to the axis of the under-thread bobbin, it is required to provide considerably large openings on the bobbin carrier and the rotating hook for permitting the enlarged light range to pass through each of the bobbin carrier and the rotating hook.

However, such large openings formed on each of the bobbin carrier and the rotating hook will reduce the structural strength of the bobbin carrier and the rotating hook. In addition, thread dust and cloth dust tend to accumulate in the vicinity of these openings, and decrease detection accuracy of the detecting means.

Further, it is also known that, for example as disclosed in JP-U1 No. 55-43897 (corres. to U.S. Pat. No. 4,237,807), in a vertically-arranged rotating-hook type sewing machine, the light rays emitted from the light emitted device of the detecting means of the sewing machine are oriented in a direction parallel to an axis of the under thread bobbin.

In this type of the sewing machine, it is necessary to form in a portion of the rotating hook an opening for permitting the light rays to pass through the rotating hook in a direction parallel to the axis of the under-thread bobbin. However in this case, since the light rays are permitted to pass through the opening of the rotating hook only when the opening is aligned with a path of the light rays parallel to the axis of the under-thread bobbin, it is necessary to take a timing of such alignment. This will make the detecting control more complex.

Furthermore, in this case, it is very difficult to provide the light emitting device and the light receiving device around the rotating hook, and the detecting means becomes more complex in construction.

SUMMARY OF THE INVENTION

It is an object of the present invention to provide an apparatus for detecting/displaying a residual quantity of a lower or under thread of a sewing machine, which apparatus is simple in construction while reliable in detection accuracy of the residual quantity of the lower or under thread of the sewing machine.

The above object of the present invention is accomplished by providing a lower thread amount display device of a sewing machine, comprising:

- a photosensor means mounted on a central shaft, the photosensor including a light emitting element and a light receiving element, the light from said light emitting element illuminating an under surface of a cover plate through an opening formed on a bottom of a bobbin carrier and through flanges of the bottom;
- a reflecting means provide on the under surface of the cover plate such that the light from the light emitting element is reflected by the reflecting means and is oriented to the light receiving means;
- a means for converting an amount of light received by the light receiving means to an amount of the lower thread wound around the axis of the bobbin; and
- a means for displaying the amount of the lower thread, the displaying means including a plurality of light emitting diodes arranged in alignment and defining a plurality of display regions.

The above object of the present invention is also accomplished by providing a displaying apparatus of a sewing machine described above, wherein:

the converting means compares the amount of the light received by the light receiving means with a plurality of predetermined reference values and designates the corresponding display regions by means of the compared results.

DESCRIPTION OF THE PREFERRED EMBODIMENTS

Hereinbelow, preferred embodiments of the present invention will be described in detail with reference to the accompanying drawings.

Figure 3:
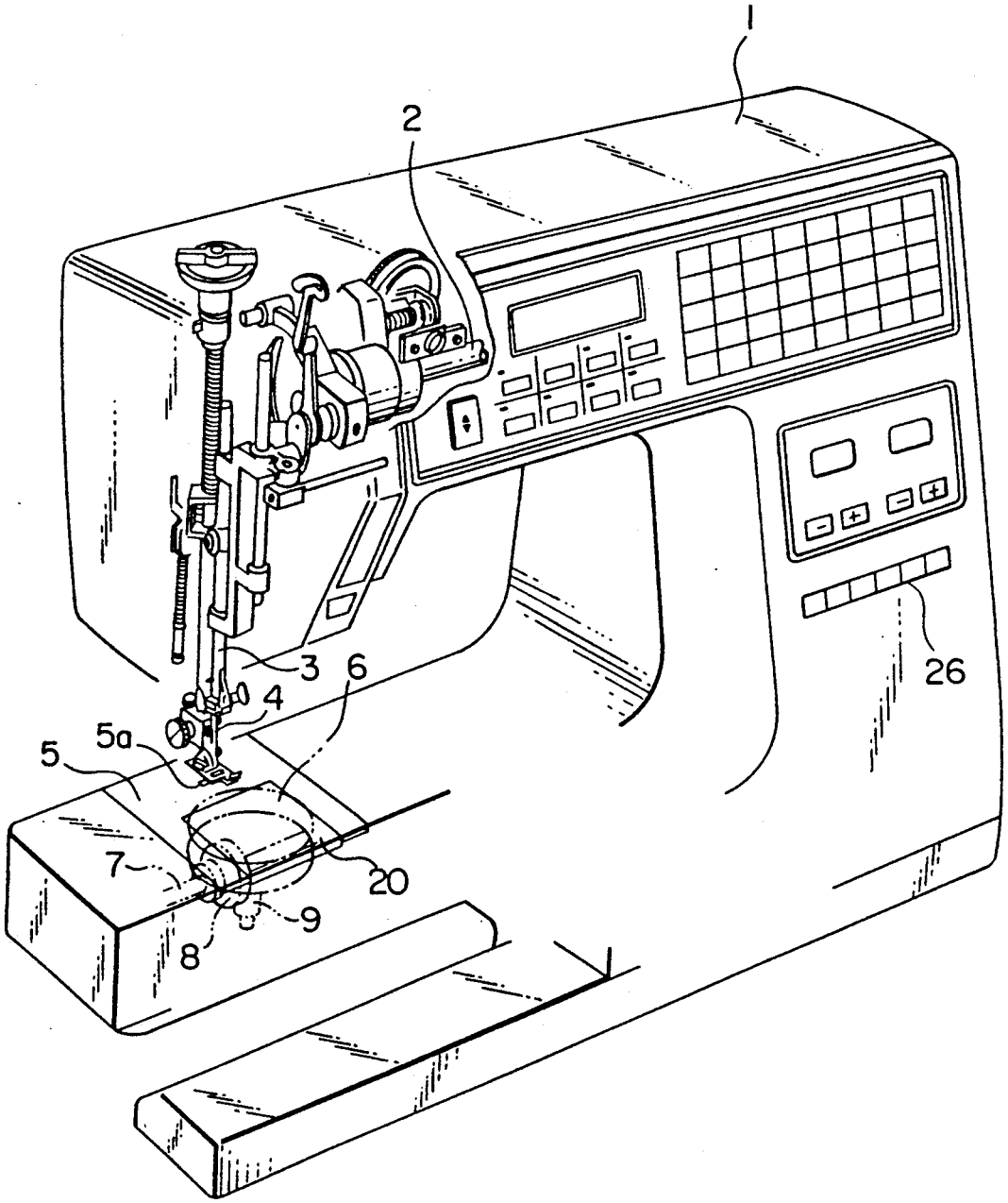
FIG. 3 is a perspective view of the sewing machine in which the apparatus of the present invention shown in FIG. 1 is employed.

FIG. 3 is a perspective view of a sewing machine employing an apparatus of the present invention for detecting/displaying a residual quantity of lower or under thread of the sewing machine.

Incidentally, in the sewing machine shown in FIG. 3, sewing and vertical motion of a sewing needle, feed motion of feed dogs, motion of a rotating hook or needle thread loop taker the like motions are similar to those disclosed in the prior art, for example such as that disclosed in JP-A No. 55-73287 filed by JANOME SEWING MACHINE COMPANY LIMITED, and therefore these motions are not described here in detail to avoid redundancy in description.

As shown in FIG. 3, a driving shaft 2 is rotatably mounted in a sewing machine frame 1, while connected with a primary driving motor (not shown) of the sewing machine. A needle bar 3 is movable mounted in the sewing machine frame 1, and so connected with the driving shaft 2 as to be moved up and down.

A throat plate 5 is disposed in a portion of the sewing machine frame 1 under the needle bar 3, and is provided with a hole 5*a* through which a sewing needle 4 fixed to a lower end of the needle bar 3 passes.

In FIG. 3, the reference numeral 6 denotes a needle-thread loop taker or rotating hook. As is clear from FIGS. 1 and 2, the rotated hook 6 is rotatably and concentrically mounted on a stationary shaft 13 in a position under the throat plate 5. The stationary shaft 13 is fixedly mounted on a mounting base 16 which is in turn fixedly mounted on a mounting plate 15 fixedly mounted on the sewing machine frame 1. The rotating hook 6 is concentrically provided with a gear 9 is its lower portion. The gear 9 of the rotating hook 6 is meshed with a gear 8 which is concentrically fixed to a lower shaft 7. This lower shaft 7 is connected with the driving shaft 2 so as to be rotatably driven by the driving shaft 2 in synchronism with the up-and down motion of the sewing needle 4.

The rotating hook 6 is prevented from moving in an axial direction of the stationary shaft 13 by means of: a bearing 14 fixed to a lower end position of the stationary shaft 13; and a flange portion 13*a* formed in an upper end of the stationary shaft 13.

Figure 1:
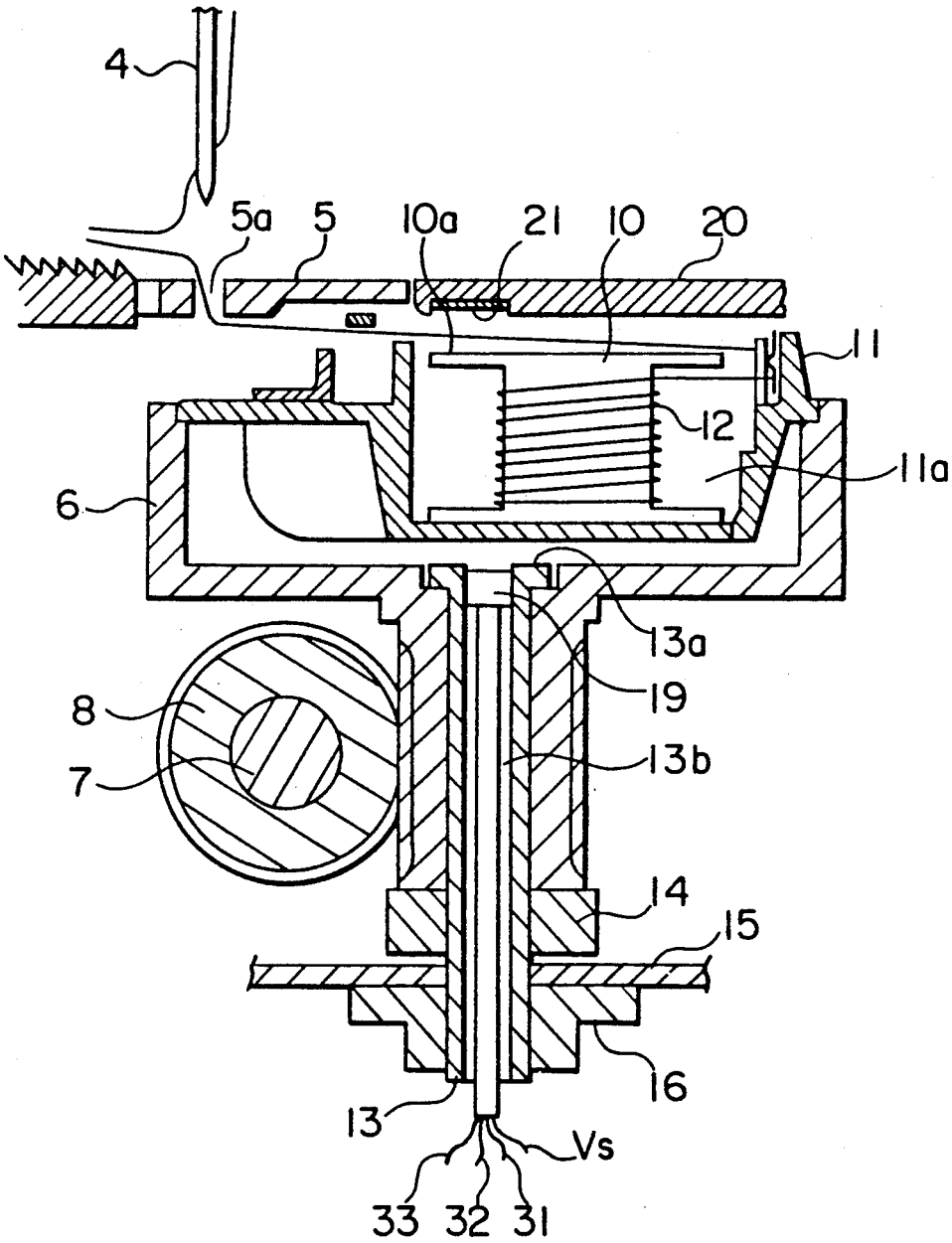
FIG. 1 is a cross-sectional view of the lower thread amount display apparatus of a sewing machine in accordance with the present invention.
Figure 2:
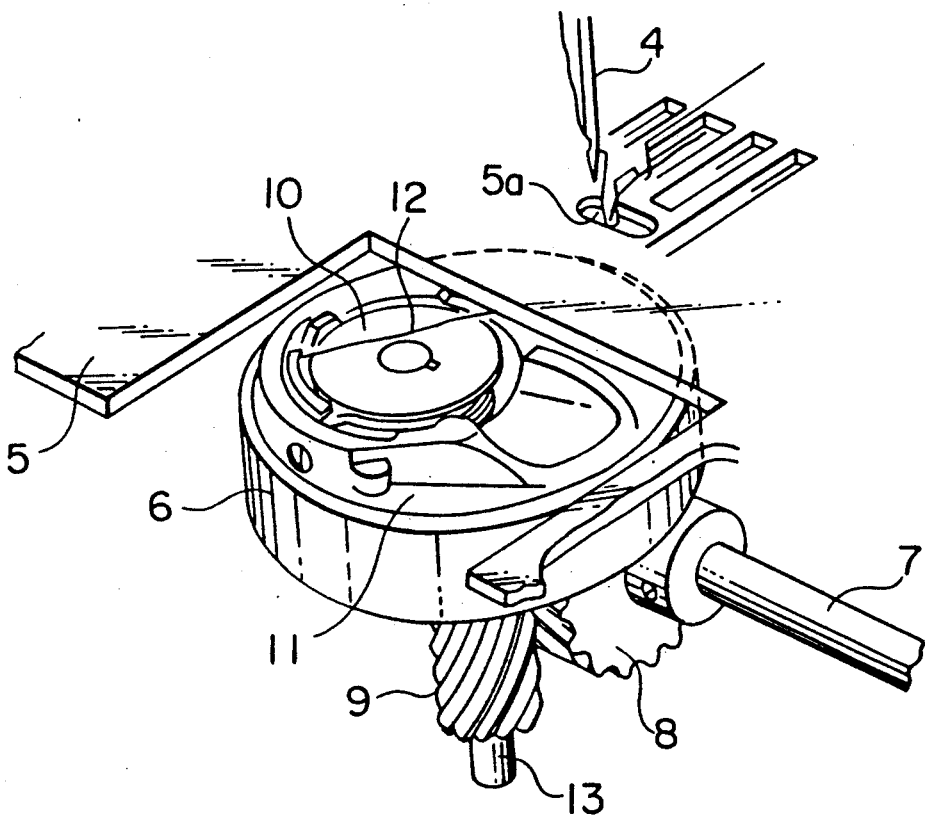
FIG. 2 is an enlarged perspective view of the apparatus of the present invention shown in FIG. 1.

As shown in FIG. 1, a bobbin carrier 11 is mounted in the rotating hook 6, while being prevented from rotating by means of an anti-rotation means (not shown).

An under-thread bobbin 10, on which an under or lower thread 12 is wound, is rotatably mounted in the bobbin carrier 11. The bobbin 10 is made of a transparent material.

The bobbin carrier 11 is provided with a space 11*a* which permits light ray having passed through the under-thread bobbin 10 to pass therethrough.

As shown in FIG. 1, the stationary shaft 13 is provided with a hollow axial portion 13*b* in an upper portion of which is disposed a photosensor 19 which is constructed of: a light emitting device 17 for emitting light rays in the axial direction of the under-thread bobbin 10 toward a radial flange portion 10*a* thereof: and a light receiving device 18 for receiving reflected rays derived from the light rays.

The photosensor 19 is electrically connected with respective terminals of the sewing machine frame 1 through cables such as an elastic power supply cable, output-signal cable and the like, which cables pass through the hollow axial portion 13*b* of the stationary shaft 13.

In FIG. 1, the reference numeral 20 denotes a square plate. The square plate 20 is disposed over the under-thread bobbin 10 mounted in the bobbin carrier 11, while detachably engaged with the throat plate 5. A reflecting element or reflector 21, from which the light rays having been emitted from the light emitting device 17 of the photosensor 19 are reflected to produce the reflected rays, is fixedly mounted on a back surface of the square plate 20 so that the reflected rays impinge on the light receiving device 18 of the photosensor 19. The reflecting element 21 is preferably constructed of a conventional reflecting tape such as SCOTCH LIGHT TAPE (trademark in Japan) and the like for producing irregularly-refrected rays.

In the photosensor 19, the light receiving device 18 receives the reflected rays having passed through the transparent radial flange portions 10*a* of the under-thread bobbin 10 to produce a voltage corresponding an amount of light received by the light receiving device 18, so that the voltage varies as the amount of light or irradiated area of the light receiving device 18 varies.

Figure 4:
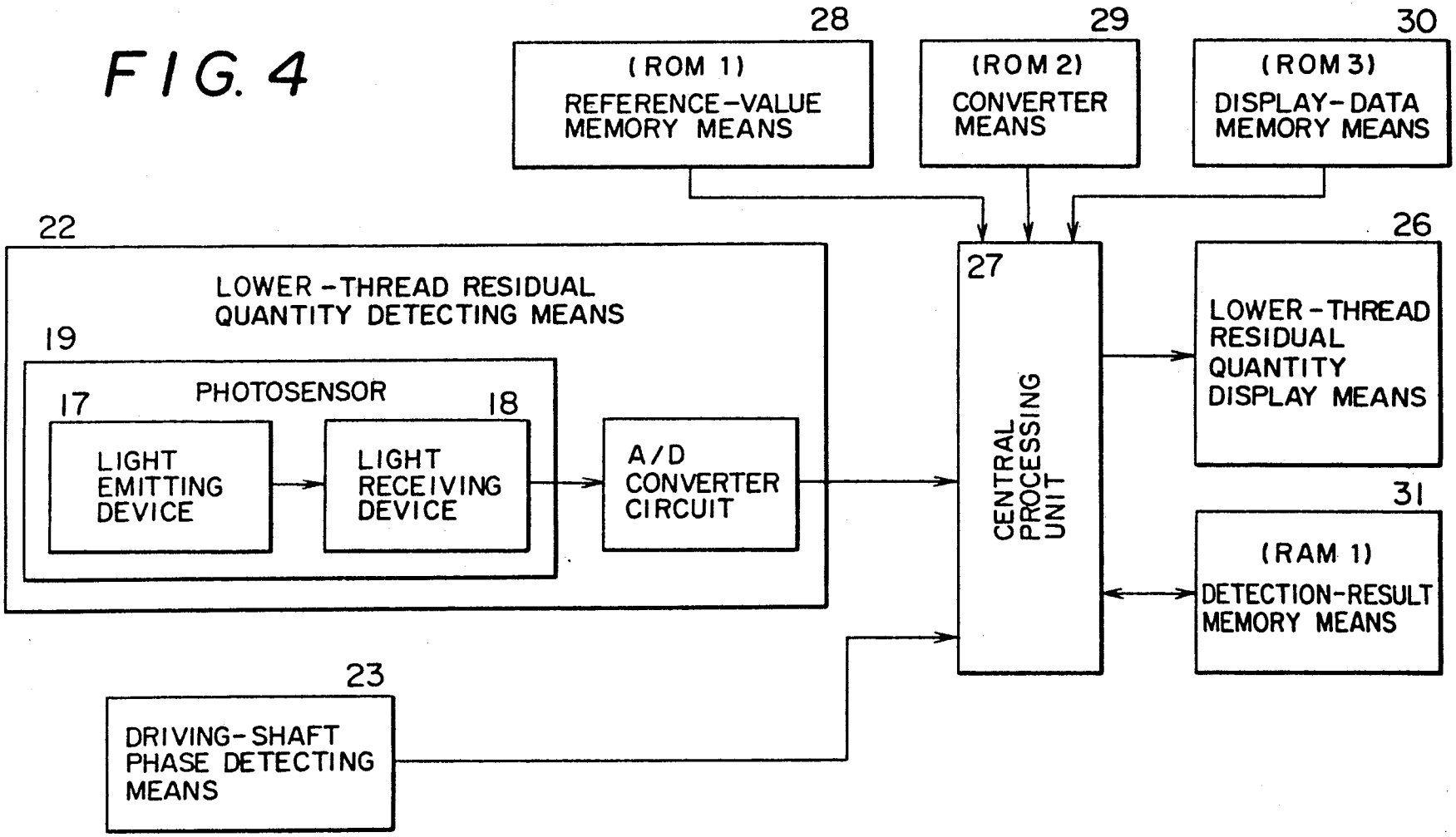
FIG. 4 is a block diagram of a control circuit of the apparatus of the present invention shown in FIG. 1.

Since the irradiated area of the light receiving device 18 of the photosensor 19 corresponds to an unwound amount of the under thread 12 wound on the bobbin 10, it is possible to easily determined a residual quantity of the under thread 12 wound on the bobbin on the basis of such irradiated area of the light receiving device 18. As shown in FIG. 4, a bobbin-thread residual quantity detecting means 22 is constructed of: the photosensor 19 constructed of the light emitting device 17 and the light receiving device 18; and the reflecting element 21.

Figure 7:
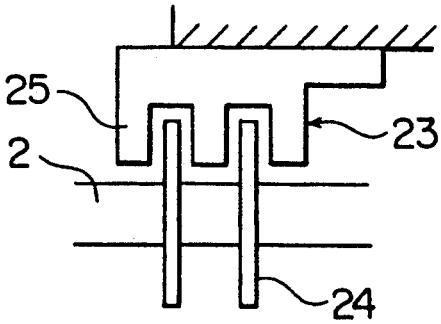
FIG. 7 is a means for detecting a phase of a driving shaft of the apparatus of the present invention shown in FIG. 1.

In FIG. 4, the reference numeral 23 denotes a driving shaft phase detecting means. As shown in FIG. 7, the driving-shaft phase detecting means 23 is constructed of: a rotating plate 24 fixedly mounted on the driving shaft 2; and a light-interrupting member 25 fixedly mounted on the sewing machine flame 1.

The driving-shaft phase detecting means 23 detects a phase of the driving shaft 2 during sewing operation in a conventional manner, for example such as that disclosed in said JP-A No. 55-73287, which is not described herein in detail to avoid redundancy in description.

Figure 6:
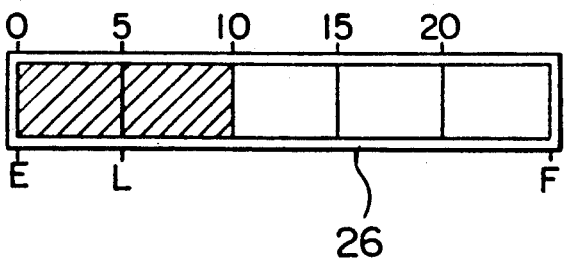
FIG. 6 is a front view of an embodiment of a display means for displaying the residual quantity of the lower thread of the apparatus of the present invention shown in FIG. 1.

In FIG. 3, the reference numeral 26 denotes a bobbin-thread residual quantity display means for displaying a residual quantity of the lower or under thread 12 still having been wound on the bobbin 10. The display means 26 is so mounted on the sewing machine frame 1 as to face toward the operator of the sewing machine. In a condition in which the under-thread bobbin 10 is filled with the under thread 12, the irradiated area of the light receiving device 18 reduces to the minimum so that the bobbin-thread residual quantity display means 26 provides a presentation of a display F. As the lower or under thread 12 is gradually unwound from the bobbin 10 during the sewing operation, the display means 26 provides a presentation of a display L indicating a condition in which a residual quantity of the under thread 12 wound on the bobbin 10 is reduced to a predetermined amount, and then provides a presentation of a display E indicating a condition in which the bobbin 10 should be replaced with a new one filled with the under thread 12. As shown in FIG. 6, these displays F, L and E are sequentially illuminated by light emitting diodes (LED) so as to correspond to the residual quantity of the under thread 12 wound on the bobbin 10, which quantity is detected by the lower-thread residual quantity detecting means 22.

In FIG. 6, each of integral numbers 0 to 20 indicates the residual quantity or length of the under thread 12 still having been wound on the bobbin 10.

A control means for controlling the apparatus of the present invention will be described with reference to FIG. 4.

In FIG. 4, the reference numeral 27 denotes a central processing unit (CPU) which is housed in the sewing machine frame 1. As shown in FIG. 4, connected with the central processing unit 27 are: the lower-thread residual quantity detecting means 22 constructed of the photosensor 19 and an A/D converter circuit; the driving-shaft phase detecting means 23; a detection-result memory means (RAM 1) 31; the lower-thread residual quantity display means 26; a display-data memory means (ROM 3) 30; a converter means (ROM 2) 29; a reference-value memory means (ROM 1) 28; a pattern selecting means (not show); and a pattern display means (not shown).

The reference-value memory means 28 stores a plurality of predetermined digital reference values corresponding to a plurality of display areas of the lower-thread residual quantity display means 26.

On the other hand, the converter means 29 converts the amount of light impinged on the light receiving device 18 of the photosensor 19 into a digital value corresponding to the residual quantity of the under thread 12 wound on the bobbin 10 through analog-to-digital conversion. In addition, the converter means 29 stores a system program for issuing an instruction signal to the central processing unit 27. According to the instruction signal issued from the converter means 29, the central processing unit 27 compares the thus converted digital value with the data stored in the reference-value memory means 28, and instructs the lower thread residual quantity display means 26 to provide the corresponding display presentation or to illuminate the corresponding display areas thereof.

The display-data memory means 30 fixedly stores; a message relating to the lower-thread residual quantity and pattern display; or dot-pattern data for graphic display and like data.

The detection-result memory means 31 temporarily stores detection results or digital values detected by the lower-thread residual quantity detecting means 22, which detection results are retrievable from the detection-result memory 31.

Now, an embodiment of an electric circuit of the lower thread residual quantity detecting means 22 will be described with reference to FIG. 5.

Figure 5:
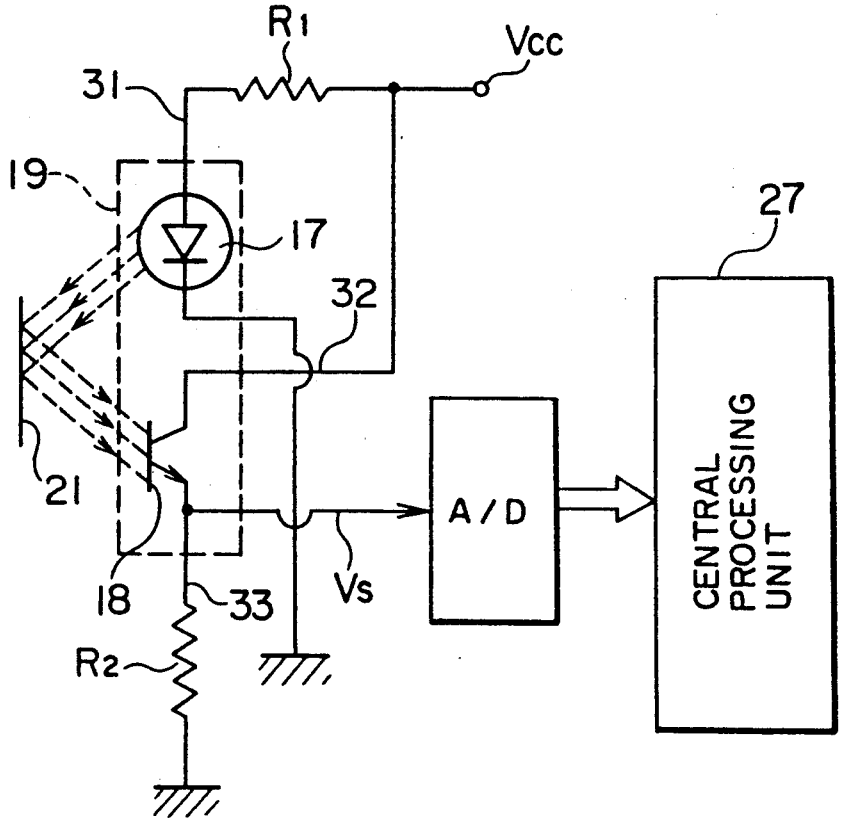
FIG. 5 is an electric circuit of an embodiment of a detecting means for detecting the residual quantity of the lower thread of the device of the present invention shown in FIG. 1.

In FIG. 5, the light emitting device 17 of the photosensor 19 is constructed of an infrared light emitting diode and the like.

The infrared rays emitted from the light emitting device 17 of the photosensor 19 can be continuous rays, intermittent rays or modulated rays.

On the other hand, the light emitting device 17 of the photosensor 19 is constructed of a phototransistor and the like.

In FIG. 5: the reference character R1 denotes a load residence for light emitting device 17; and R2 a load resistance for the light receiving device 18.

The light receiving device or phototransistor 17 decreases in internal impedance as the amount of light impinged on the light receiving device 17, as is well known in the prior art.

As a result, a terminal voltage VS of the load resistance R2 increases in proportion to the amount of light impinged on the light receiving device 18 of the photosensor 19.

Consequently, it is possible to define the terminal voltage VS of the load resistance R2 as a function of the residual quantity of the under thread 12 wound on the bobbin 10. The terminal voltage VS forms an output voltage of the light receiving device or phototransistor 17 of the photosensor 19.

In FIG. 5, the reference character A/D denotes an analog-to-digital (A/D) converter circuit for converting the output voltage VS or analog value VS into a digital value processed in the central processing unit 27.

In FIG. 5, the reference character $V_{cc}$ denotes an electric power source in a circuit of the photosensor 19.

Operation for detecting the residual quantity of the under thread 12 wound on the bobbin 10 will be described in accordance with the apparatus of the present invention.

The light rays emitted from the light emitting device or infrared light emitting diode 17 of the photosensor 19 pass through an aperture of the bobbin carrier 11, and then pass through the radial flange portions 10*a* of the underthread bobbin 10 to impinge on the reflecting element 21 fixedly mounted on the back surface of the square plate 20, from which element 21 the light rays are reflected to produce the reflected rays. The thus produced reflected rays return to the photosensor 19 or light receiving device 18 thereof though the same path as that of the light rays emitted from the light emitting device 17 of the photosensor 19. Namely, the reflected rays pass through both of the radial flange portions 10*a* of the bobbin 10 and the aperture of the bobbin carrier 11 again to impinge on the light receiving device 18 of the photosensor 19.

As the amount of light impinged on the light receiving device 18 of the photosensor 19 increases, the light receiving device 18 or phototransistor decreases in internal impedance. As a result, the terminal voltage VS of the load resistance R2 increases in proportion to the amount of light impinged on the light receiving device 10 of the photosensor 19.

As shown in FIG. 5, the output voltage VS of the light receiving device 18 or phototransistor of the photosensor 19 is converted into a digital value through analog-to-digital converter circuit (A/D). As shown in FIG. 4, the thus converted digital value is then stored in the detection-result memory means (RAM 1) 31.

In the central processing unit 27, the above digital value is compared with the plurality of the reference digital values stored in the reference-value memory means 28, by using the system program stored in the converter means (ROM 2) 29. The plurality of the reference digital values stored in the reference-value memory means 28 correspond to the plurality of display areas of the lower-thread residual quantity display means 26. The system program stored in the converter means (ROM 2) 29 issues the instruction signal to the central processing unit 27.

As described above, according to the instruction signal issued from the converter means (ROM 2) 29, the central processing unit 27 compares the thus converted digital value with the data stored in the reference-value memory means 28, and instructs the lower thread residual quantity display means 26 to provide the corresponding display presentation or to illuminate the corresponding display areas thereof.

Another embodiment of the electric circuit of the lower-thread residual quantity detecting means 22 will be described with reference to FIG. 8.

Figure 8:
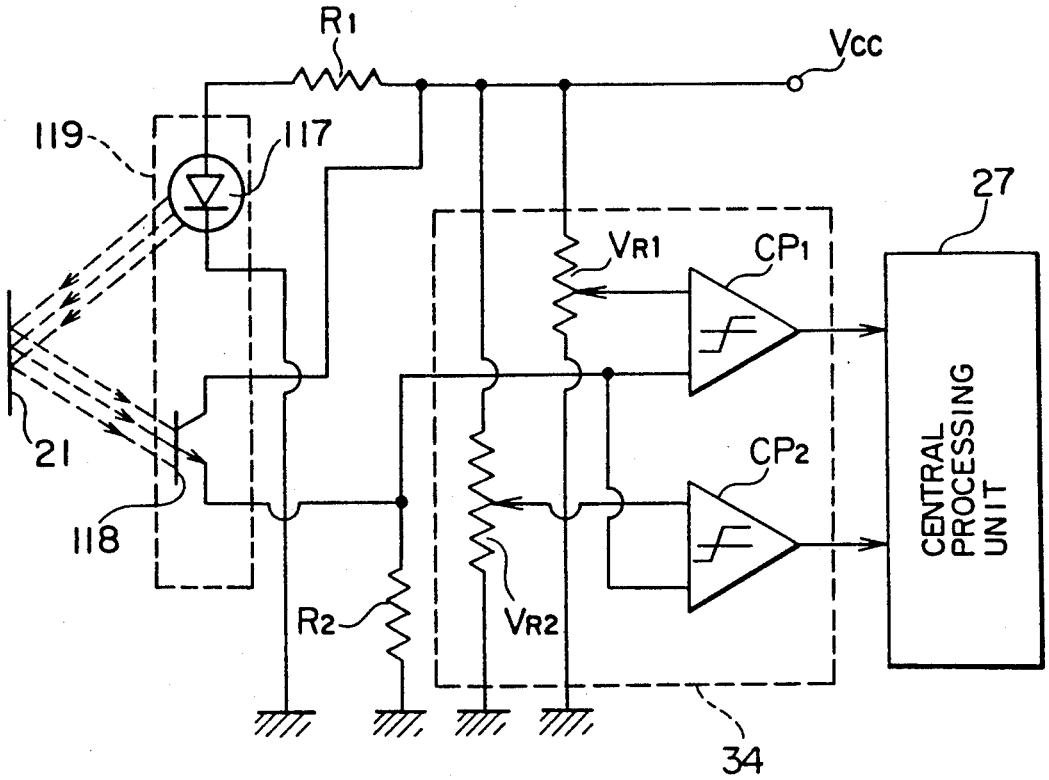
FIG. 8 is an electric circuit of another embodiment of the detecting means for detecting the residual quantity of the lower thread of the device of the present invention shown in FIG. 1.

In FIG. 8: the reference numeral 117 denotes an infrared light emitting diode; R1 is a load resistance for the light emitting diode 117; and R2 is a load resistance for the light receiving device 118.

In FIG. 8, the reference character $V_{cc}$ denotes an electric power source of the circuit of the photosensor 19.

Connected to an output side of the light receiving device 118 are a plurality of comparators CP1, CP2 which are connected to variable resistors VR1, VR2 respectively to to have their reference voltage differ from each other.

Consequently, the output voltage of the light receiving device 118 corresponding to the residual quantity of the under thread 12 wound on the bobbin 10 is compared with each of the reference voltages in the comparator CP1, CP2 to make it possible that any one of the comparators CP1, CP2 issues a signal to the central processing unit 27. According to the signal, the central processing unit 27 instructs the lower-thread residual quantity display means 26 to display the residual quantity of the under thread 12 wound on the bobbin 10.

Incidentally, the under-thread bobbin 10 is made of a transparent material, while provided with the radial flange portions 10*a* with tapered edges. These tapered edges of the flange portions 10*a* of the bobbin 10 are formed when the bobbin 10 is formed.

Figure 9:
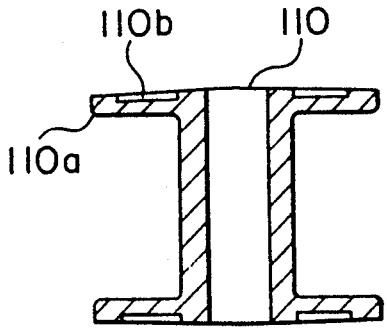
FIG. 9 is a cross-sectional view of the lower or under thread bobbin which permits the light rays emitted from the photosensor of the apparatus of the present invention shown in FIG. 1 to pass through the radial flange portions of the under-thread bobbin.
Figure 10:
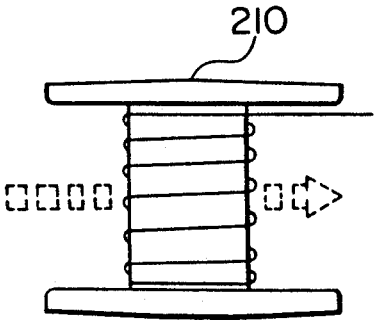
FIG. 10 PRIOR ART
FIG. 10 is a side view of a conventional under-thread bobbin, illustrating that the light rays employed to detect the residual quantity of the under thread wound on the bobbin are oriented in a direction perpendicular to an axis of the under-thread bobbin.

In addition, as shown in FIG. 9, according to another embodiment of the under-thread bobbin 110, it is also possible for the under-thread bobbin 110 to have its flange portions 110*a* form a plurality of thin-wall portions 110*b* in their outer radial surfaces perpendicular to the axis of the bobbin 110, so that the light rays emitted from the light emitting device 17, 117 of the photosensor 19, 119 impinge on the thin-wall portions 110*b* of the flange portions 110*a* of the bobbin 110 in a direction parallel to the axis of the bobbin 110 to make it possible that the light rays emitted from the light emitting device 17, 117 of the photosensor 19, 119 pass through the flange portions 110*a* of the bobbin 110 without fail.

In the above embodiments of the apparatus of the present invention, the photosensor 19, 119 is disposed in the axial hollow central portion of the stationary shaft 13. However, it is also possible to dispose the photosensor 19, 119 out-side the stationary shaft 13 so that optical fibers are disposed in the axial hollow central portion of the stationary shaft 13 in place of the photosensor 19, 119, the optical fibers being connected to the photosensor 19, 119 which emits the light rays and receives the reflected rays derived from the light rays through the optical fibers.

As described above, in the apparatus of the present invention: the lower-thread residual quantity detecting means 22 is disposed inside the stationary shaft 13 on which the rotating hook 6 is rotatably mounted, in which hook 6 the under-thread bobbin 10, 110 and the bobbin carrier 11 are mounted; and the reflecting element 21 is fixedly mounted on the back surface of the square plate 20 detachably engaged with the throat plate 5 to reflect the light rays emitted from the photosensor 19, 119, so that the reflected rays reflected from the reflecting element 21 are impinged on the photosensor 19, 119 to make it possible that the photosensor 19, 119 detects the residual quantity of the under thread 12 wound on the bobbin 10, 110. As a result, in contrast with the conventional apparatus for detecting the residual quantity of the under thread, in the apparatus of the present invention, there is no fear that a deposit of cloth dust and like dusts accumulated outside the outer peripheral portion of the rotating hook 6 prevents the lower-thread residual quantity detecting means 22 from achieving its function. Consequently, it is possible for the apparatus of the present invention to correctly detect and display the residual quantity of the lower thread 12 wound on the bobbin 10, 110 of the sewing machine.

What is claimed is:

1. A lower thread amount display device of a sewing machine having a rotatable drive shaft which is rotated to vertically reciprocate a machine needle through a throat plate, a hook operatively connected to the drive shaft and rotated in synchronism with the vertical reciprocation of the needle carrying an upper thread, the hook being rotated around a vertical stationary shaft below the throat plate and having a bobbin carrier located therein, the bobbin carrier carrying a bobbin therein, the bobbin having a central axis and two substantially transparent flanges, one of said flanges being on one end of the central axis and the other of said flanges being on the opposite end of the central axis, the bobbin having a lower thread wound around the central axis thereof, and a cover plate located above the hook and cooperating with the throat plate to provide a flat place for carrying a fabric thereon to be sewn, the machine needle and the hook cooperating with each other to form lock stitches with the upper and lower threads, said lower thread amount display device comprising:

photosensor means mounted on said central axis, said photosensor means including a light emitting element and a light receiving means, the light emitting element being arranged such that light from said light emitting element illuminates an under surface of said cover plate through an opening formed on a bottom of said bobbin carrier and through said substantially transparent flanges of said bobbin;

reflecting means provided on the under surface of said cover plate for reflecting the light from said light emitting element toward said light receiving means;

means for converting an amount of light received by said light receiving means to an amount of said lower thread wound around the central axis of said bobbin; and display means for displaying said amount of said lower thread wound around the central axis of said bobbin, said display means including a plurality of light emitting diodes arranged in alignment and defining a plurality of display regions.

2. The lower thread amount display device as defined in claim 1, wherein said converting means comprises:

means for converting the amount of light received by said light receiving means into a digital value;

means for storing a plurality of digital values, each digital value corresponding to each of said display regions; and means for comparing said converted digital value with said stored digital values stored in said storing means, and for producing a signal indicating at least one digital region corresponding to said converted digital value.

3. The displaying device as defined in claim 1, wherein said converting means comprises:

means for storing a plurality of voltages, each voltage corresponding to each of said display regions; and means for comparing said amount of light received by said light receiving means with said stored voltages, and for producing a signal indicating at least one display region corresponding to said amount of light received by said light receiving means.

* * * * *